US011208782B2

(12) United States Patent
Erhardt et al.

(10) Patent No.: US 11,208,782 B2
(45) Date of Patent: Dec. 28, 2021

(54) POST DRIVING IMPLEMENT

(71) Applicant: Clark Equipment Company, West Fargo, ND (US)

(72) Inventors: Cody Erhardt, Bismarck, ND (US); Brian Dehnert, Mandan, ND (US); Patrick Link, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/816,837

(22) Filed: Mar. 12, 2020

(65) Prior Publication Data

US 2020/0208370 A1 Jul. 2, 2020

Related U.S. Application Data

(62) Division of application No. 16/282,958, filed on Feb. 22, 2019, now abandoned.

(60) Provisional application No. 62/634,447, filed on Feb. 23, 2018.

(51) Int. Cl.

| | |
|---|---|
| ***E02D 7/10*** | (2006.01) |
| ***E04H 17/26*** | (2006.01) |
| ***E02F 3/06*** | (2006.01) |

(52) U.S. Cl.

CPC ..... *E02D 7/10* (2013.01); *E02F 3/06* (2013.01); *E04H 17/265* (2013.01); *E04H 17/263* (2013.01)

(58) Field of Classification Search

CPC .. E02D 7/10; E02D 7/02; E02D 13/00; E04H 17/263; E04H 17/265; E02F 3/06; E02F 3/963; E02F 3/966; E02F 3/413

See application file for complete search history.

(56) References Cited

U.S. PATENT DOCUMENTS

| | | | |
|---|---|---|---|
| 3,216,511 | A | 11/1965 | Ladd et al. |
| 3,243,905 | A | 4/1966 | Ulrich |
| 3,333,646 | A | 8/1967 | Hoen et al. |
| 3,507,338 | A | 4/1970 | McWaters et al. |

(Continued)

FOREIGN PATENT DOCUMENTS

| | | | |
|---|---|---|---|
| EP | 0641618 | A1 | 3/1995 |
| FR | 2130831 | B5 | 11/1972 |

(Continued)

OTHER PUBLICATIONS

International Search Report dated Jul. 9, 2019 for International Application No. PCT/US2019/019181 filed Feb. 22, 2019, 7 pages.

(Continued)

*Primary Examiner* — Carib A Oquendo

(74) *Attorney, Agent, or Firm* — John Veldhuis-Kroeze; Westman, Champlin & Koehler, P.A.

(57) ABSTRACT

Disclosed embodiments include post driving implements which attach to a power machine such as a loader in order to pick up posts of various sizes and materials and/or to drive the posts into the ground. In some exemplary disclosed embodiments, the post driving implement allows a post to be picked up when positioned inline with a direction of power machine travel and allows the post to rotate under the force of gravity to a second position in which the post is inline with a pounding mechanism for pounding the post into the ground. Catch mechanisms can be included to capture a portion of the implement to maintain the post in the second position until a release action is taken or a release command is given.

10 Claims, 9 Drawing Sheets

(56) References Cited

U.S. PATENT DOCUMENTS

| | | | |
|---|---|---|---|
| 3,771,610 | A | 11/1973 | Leyrat |
| 4,915,180 | A | 4/1990 | Schisler |
| 5,282,511 | A | 2/1994 | Burenga et al. |
| 5,375,664 | A | 12/1994 | McDowell et al. |
| 6,105,683 | A | 8/2000 | Thiessen |
| 6,305,480 | B1 | 10/2001 | Franklin |
| 6,494,515 | B1 | 12/2002 | Kalbfleisch |
| 6,517,294 | B2 | 2/2003 | Vreeland |
| 6,591,919 | B1 | 7/2003 | Herrmann |
| 6,702,037 | B1 | 3/2004 | Thiessen |
| 6,715,563 | B2 | 4/2004 | Hubbard |
| 6,889,777 | B2 | 5/2005 | Boley et al. |
| 7,152,694 | B2 | 12/2006 | Dennis |
| 7,410,008 | B2 | 8/2008 | Jahnigen |
| 7,597,156 | B1 | 10/2009 | Reid |
| 7,658,240 | B2 | 2/2010 | Anderson |
| 8,272,824 | B1 | 9/2012 | Putney |
| 8,414,043 | B2 | 4/2013 | Albin et al. |
| 8,752,876 | B2 | 6/2014 | Niekamp et al. |
| 2007/0134075 | A1 | 6/2007 | Bunting |
| 2008/0181756 | A1 | 7/2008 | Moffitt |
| 2008/0190633 | A1 | 8/2008 | Johnston et al. |
| 2009/0008113 | A1 | 1/2009 | Lyons et al. |
| 2009/0290940 | A1 | 11/2009 | Martin, Sr. |
| 2012/0014755 | A1 | 1/2012 | Raunisto |
| 2013/0140052 | A1 | 6/2013 | Niekamp et al. |
| 2013/0140053 | A1 | 6/2013 | Niekamp et al. |
| 2013/0140836 | A1 | 6/2013 | Niekamp et al. |
| 2014/0037415 | A1 | 2/2014 | Zuritis |
| 2015/0233763 | A1 | 8/2015 | Holub |
| 2016/0090707 | A1 | 3/2016 | Korherr et al. |

FOREIGN PATENT DOCUMENTS

| | | | |
|---|---|---|---|
| JP | S57184127 | A | 11/1982 |
| JP | S6323351 | U | 2/1988 |
| JP | H11314879 | A | 11/1999 |
| JP | 2008121219 | A | 5/2008 |
| WO | 2017066833 | A1 | 4/2017 |

OTHER PUBLICATIONS

Written Opinion dated Jul. 9, 2019 for International Application No. PCT/US2019/019181 filed Feb. 22, 2019, 18 pages.

Invitation to Pay Additional Fees and, Where Applicable, Protest Fee, dated May 2, 2019 for International Application No. PCT/US2019/019181 filed Feb. 22, 2019, 14 pages.

POST DRIVING IMPLEMENT

CROSS-REFERENCE TO RELATED APPLICATION

The present application is a divisional of and claims priority of U.S. patent application Ser. No. 16/282,958, filed Feb. 22, 2019, which claims the benefit of U.S. Provisional Application No. 62/634,447, filed Feb. 23, 2018, the contents of which are hereby incorporated by reference in their entireties.

BACKGROUND

The present disclosure is related to implements for attachment to a power machine. More particularly, the present disclosure is related to an implement attachable to a power machine for picking up and pounding posts into the ground or pulling posts from the ground.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Some examples of work vehicle power machines include loaders, excavators, utility vehicles, tractors, and trenchers, to name a few.

Some power machines can be operably coupled to implements that are capable of cooperating with the power machine to perform various tasks. For example, some loaders have lift arms that are capable of having a wide variety of implements operably coupled to them, ranging from a simple bucket or blade to relatively complex implements such as planers and graders that have work devices capable of performing various tasks. Some of these work devices on implements are controllable by operator input devices on the power machines to which they are operably coupled. Many power machines of this type are capable of providing power and/or control signals to an operably coupled implement. Thus, when a particular power machine is operably coupled to an implement, a connection is made between one or more power and/or control signal sources on the power machine and the implement. One common type of power source on such types of power machines is a hydraulic power source. Pressurized hydraulic fluid is selectively provided from the power machine to the implement once the connection is made. To connect and disconnect an implement from a power machine, the hydraulic connections between the machine and implement must be made and broken.

Implements for handling a pole or post (hereafter collectively referred to as posts) are known, as are implements or devices for pounding or driving a post into the ground. Some implements are capable of handling a post but require a separate post driver to place the same into the ground. Also, many post handling implements and/or post driving implements require that the post be lying on the ground transverse to the direction of travel of the loader or other power machine when the post is to be picked up. Requiring transverse orientation of the post can be disadvantageous, for example limiting areas in which the implement and power machine can be used.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter.

The present disclosure includes post driving implements which attach to a power machine such as a loader in order to pick up posts of various sizes and materials and/or to drive the posts into the ground. In some exemplary disclosed embodiments, the post driving implement allows a post to be picked up when positioned inline with a direction of power machine travel and allows the post to rotate under the force of gravity to a second position in which the post is inline with a pounding mechanism for pounding the post into the ground. Catch mechanisms can be included to capture a portion of the implement to maintain the post in the second position until a release action is taken or a release command is given.

In some disclosed embodiments, a post driving implement (100; 100'; 200; 300) is configured to be mounted to a power machine (10) having a lift arm (35) moveable from a fully lowered position to a fully raised position and an implement carrier (50) coupled to the lift arm. The post driving implement is configured to insert a post (270) into a support surface and comprises an implement frame (122; 122'; 222) having a power machine interface (110; 110'; 210) configured engage and be coupled to the implement carrier. The post driving implement also comprises a grabbing tool (240; 340) pivotably mounted to the implement frame and configured to pick up the post lying on the support surface generally in-line with a direction of power machine travel. The grabbing tool is configured to pivot so that the post is positioned at a desired attitude relative to the support surface as the lift arm of the power machine is raised toward the fully raised position. The post driving implement also includes a pounding mechanism (229) coupled to the implement frame (122; 122'; 222) and positioned and configured to engage the post held by the grabbing tool to apply a force to urge the post into the support surface.

In some embodiments, the grabbing tool (240; 340) is configured to be pivotable relative to the implement frame between a first position, in which the grabbing tool is oriented to pick up the post lying on the support surface generally in-line with the direction of power machine travel, and a second position which positions the post generally vertically under the pounding mechanism such that the pounding mechanism can apply the force to urge the post into the support surface.

In some embodiments, the grabbing tool (240; 340) is biased toward the first position to pick up the post lying on the support surface and is configured to move under the force of gravity toward the second position, after picking up the post, as the lift arm of the power machine is raised toward the fully raised position. In some embodiments, the grabbing tool (240; 340) is configured to pivot freely from the first position, allowing the post driving implement to pick up the post lying on the support surface, to the horizontal position as the lift arm of the power machine is raised after picking up the post.

In some embodiments, the grabbing tool (240; 340) further comprises a tool frame (242) pivotally mounted to the implement frame (122; 122'; 222) to allow the grabbing tool to pivot between the first position and the second position. A pair of arms (248; 348) of the grabbing tool is pivotally mounted to the tool frame. A grabbing tool actuator (250) is coupled to the tool frame and to the pair of arms and is configured to pivot each of the pair of arms under power to selectively engage and release the post. In some embodiments, each of the pair of arms has a jaw (256) at an end thereof. The jaws are shaped to collectively grab and hold the post and can include serrated edges (259) configured to grab a post inserted into the ground to pull the post out of the ground. Further, in some embodiments, each of the pair of arms (348) can have a first gripping surfaces (357) with a first radius to grab posts of a first size and second gripping surfaces (359) with a second radius to grab posts of a second size. Each of the pair of arms can also include gripping features 361 configured to grab posts larger than the first and second sizes.

In some disclosed embodiments, a post driving implement (100; 100'; 200; 300) is configured to be mounted to a power machine (10) having a lift arm (35) moveable from a fully lowered position to a fully raised position and an implement carrier (50) coupled to the lift arm. The post driving implement is configured to insert a post (270) into a support surface and comprises an implement frame (122; 122'; 222) having a power machine interface (110; 110'; 210) configured engage and be coupled to the implement carrier. The post driving implement also includes a grabbing tool (240; 340) pivotably mounted to the implement frame and configured to pick up the post lying on the support surface. The grabbing tool is configured to pivot so that the post is positioned at a desired attitude relative to the support surface as the lift arm of the power machine is raised toward the fully raised position. A locking mechanism (260) of the implement is configured to releasably lock the grabbing tool to the implement frame when the post is positioned at the desired attitude.

In some disclosed embodiments, the locking mechanism (260) comprises a latch mechanism coupled to the implement frame. The grabbing tool also includes, in some embodiments, a feature (262) which the latch mechanism engages to releasably lock the grabbing tool to the implement frame to hold the grabbing tool in the horizontal position. The pounding mechanism (229) of the implement is coupled to the implement frame (122; 122'; 222) and positioned and configured to engage the post held by the grabbing tool to apply a force to insert the post into the support surface. When held in the horizontal position the grabbing tool positions the post generally vertically under the pounding mechanism.

In some embodiments, the post driving implement further includes a release mechanism (266) coupled to the latch or locking mechanism (260) and configured to release the grabbing tool from the horizontal position such that the grabbing tool returns to the vertical position. Further, in some embodiments, the release mechanism (266) is configured to be engaged by an arm (248) of the grabbing tool (240; 340) to release the grabbing tool from the horizontal position.

In some disclosed embodiments, a post driving implement (100; 100'; 200; 300) is configured to be mounted to a power machine (10) having a lift arm (35) moveable from a fully lowered position to a fully raised position and an implement carrier (50) coupled to the lift arm. The post driving implement is configured to insert a post (270) into a support surface and comprises an implement frame (122; 122'; 222) having a power machine interface (110; 110'; 210) configured engage and be coupled to the implement carrier. A grabbing tool (240; 340) of the implement is pivotably mounted to the implement frame and configured to pick up the post lying on the support surface. The grabbing tool is configured to pivot so that the post is positioned at a desired attitude relative to the support surface as the lift arm of the power machine is raised toward the fully raised position. The post driving implement further includes a level indicator (280) pivotally attached to one side (288) of the implement frame. The level indicator is free to move relative to the implement frame and provide an indication on another surface (282) of the implement frame of whether the post is vertical relative to the support surface. In some embodiments, the level indicator is pivotally attached to the one side (288) of the implement frame and configured to pivot about an axis (286) which is parallel to another surface (282) of the implement frame. In some embodiments, the level indicator includes a right-angle bend (284) to provide the indication on another surface (282) of whether the post is vertical relative to the support surface.

Also disclosed are methods (400) of urging a post (270) into a support surface, the methods comprising providing (410) a power machine (10) with an implement (100; 100'; 200; 300) attached thereto, the implement having a grabbing tool (240; 340) for grabbing the post. The method further includes positioning (420) the power machine in-line with the post lying on the support surface and positioning (430) the grabbing tool adjacent to the post. The method further includes grabbing (440) the post with the grabbing tool and raising (450) the implement to position the post in a desired attitude with respect to the support surface. With the post positioned at the desired attitude, the method includes driving (460) the post into the support surface using a pounding mechanism of the implement.

DETAILED DESCRIPTION

The concepts disclosed in this discussion are described and illustrated with reference to exemplary embodiments.

These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

The present disclosure includes an implement which attaches to a power machine, such as a loader, for picking up and pounding posts into the ground. In some exemplary embodiments, the posts are of a fence post size, though larger posts can be accommodated using the disclosed features. Disclosed embodiments include features which can be adapted or configured to drive various types and shapes of posts, including round wooden posts, T-shaped metal posts, or posts made in other shapes or of other materials. These concepts can be practiced on various implements, as will be described below. A representative implement 100 on which the embodiments can be practiced and a power machine 10 to which the implement can be operably coupled are illustrated in diagram form in FIG. 1 and described below before any embodiments are disclosed. For the sake of brevity, only one implement and power machine combination is discussed. However, as mentioned above, the embodiments below can be practiced on any of a number of implements and these various implements can be operably coupled to a variety of different power machines. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
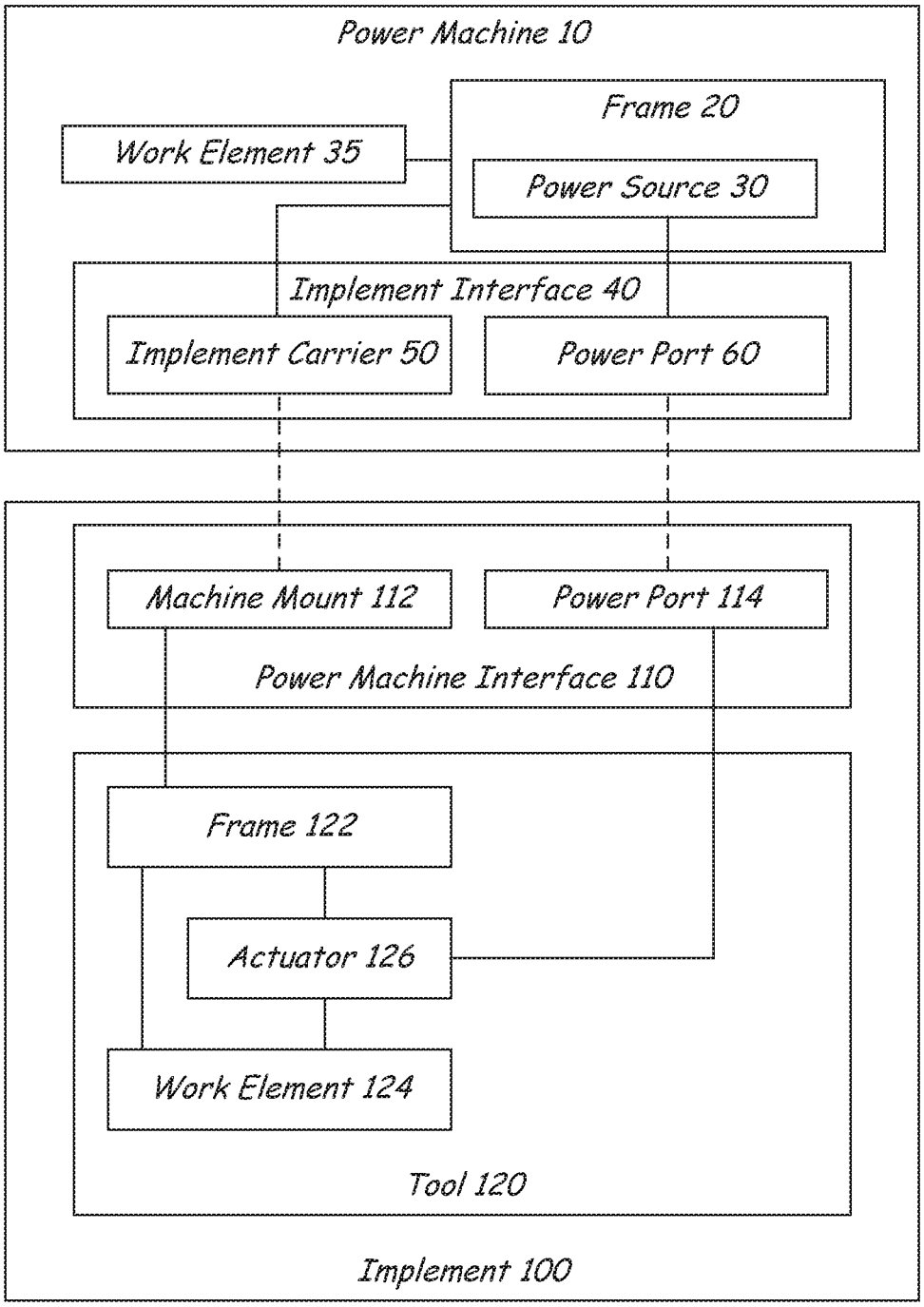
FIG. 1 is a block diagram illustrating functional systems of a representative implement on which embodiments of the present disclosure can be practiced and a power machine to which the representative implement can be coupled.

Referring now to FIG. 1, a block diagram illustrates basic systems of power machine 10 as are relevant to interact with implement 100 as well as basic features of implement 100, which represents an implement upon which the embodiments discussed below can be advantageously incorporated. At their most basic level, power machines for the purposes of this discussion include a frame 20, a power source 30, a work element 35, and, as shown in FIG. 1, an implement interface 40. On power machines such as loaders and excavators and other similar work vehicles, implement interface 40 includes an implement carrier 50 and a power port 60. The implement carrier 50 is typically rotatably attached to a lift arm or other work element and is capable of being secured to the implement. The power port 60 provides a connection for the implement 100 to provide power from the power source to the implement. Power source 30 represents one or more sources of power that are generated on power machine 10. This can include either or both of pressurized fluid and electrical power.

The implement 100, which is sometimes known as an attachment or an attachable implement, has a power machine interface 110 and a tool 120, which is coupled to the power machine interface 110. The power machine interface 110 illustratively includes a machine mount 112 and a power port 114 for coupling with power machine 10. Machine mount 112 can be any structure capable of being coupled to the implement interface 40 of power machine 10. Power port 114, in some embodiments, includes hydraulic and/or electrical couplers. Power port 114 can also include a wireless electrical connection, as may be applicable on a given implement. While both machine mount 112 and power port 114 is shown, some implements may have only one or the other as part of their power machine interface 110. Other implements, such as a bucket, would not have a power port 114 at all.

In instances where a power machine has a specific implement carrier, the machine mount 112 will include a structure that complements the specific implement carrier. For power machines without an implement carrier, the machine mount includes features to directly mount the implement 100 to the power machine 10 such as bushings to accept pins for mounting the implement to a lift arm and an actuator for moving the implement. Some implements are not intended to be physically mounted to a power machine at all. One example of an implement that is not intended to be physically mounted to a power machine would be a handheld implement.

For the purposes of this discussion, implements can be categorized as simple or complex. A simple implement has no work element. One example of a simple implement is a bucket. A complex implement has at least one actuable work element. Complex implements are further divided into those that have one actuable work element and those that have multiple work elements.

In FIG. 1, the implement 100 illustrates a tool 120 for a complex implement with a single work element 124. The tool 120 includes a frame 122, which is coupled with or integral to the machine mount 112. A work element 124 is coupled to the frame 122 and is moveable in some way (rotation, extension, etc.) with respect to the frame. An actuator 126 is mounted to the frame 122 and the work element 124 and is actuable under power to move the work element with respect to the frame. Power is provided to the actuator 126 via the power machine. Power is selectively provided in the form of pressurized hydraulic fluid (or other power source) directly from the power machine 10 to the actuator 126 via power ports 60 and 114.

Figure 2:
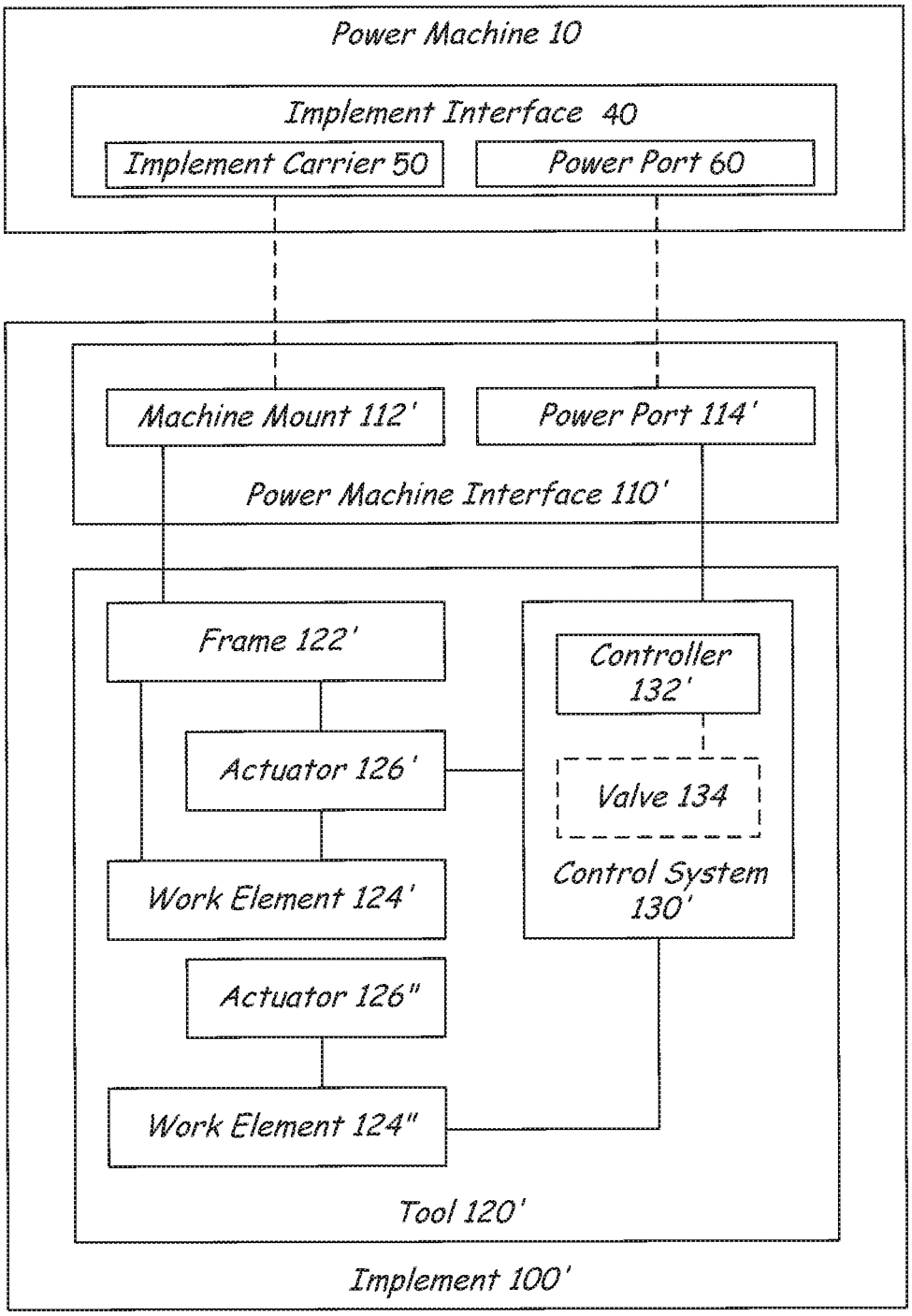
FIG. 2 is a block diagram illustrating functional systems of another representative implement on which embodiments of the present disclosure can be practiced and a power machine to which the representative implement can be coupled.

FIG. 2 illustrates an implement 100', which depicts a complex, multi-function implement. The features in FIG. 2 that are similarly numbered to those in FIG. 1 are substantially similar and are not discussed again here for the sake of brevity. Implement 100' has one or more additional work elements 124", which are shown in block form. Each work element 124" has a corresponding actuator 126" coupled thereto for controlling movement of the work element 124". A control system 130 receives power from the power machine and selectively provides power to the actuators 126' and 126" in response to signals from operator inputs. The control system 130 includes a controller 132, which is configured to receive electrical signals from the power machine 10 indicative of operator input manipulation and control power to the various actuators based on those electrical signals. The controller 132 can provide electrical signals to some or all of the actuators 126' and 126" to control their function. Alternatively, the controller 132 can control optional valve 134, which in turn controls actuation of some or all of the actuators 126' and 126" by providing pressurized hydraulic fluid to the actuators.

Although not shown in either of FIGS. 1-2, in some instances, controller 132 can receive signals indicative of operator actuation of user inputs that are mounted on the implement, as opposed to the power machine. In these applications, the implement is controlled from an operator position that is located remotely from the power machine (i.e. next to the implement 100').

Figure 3:
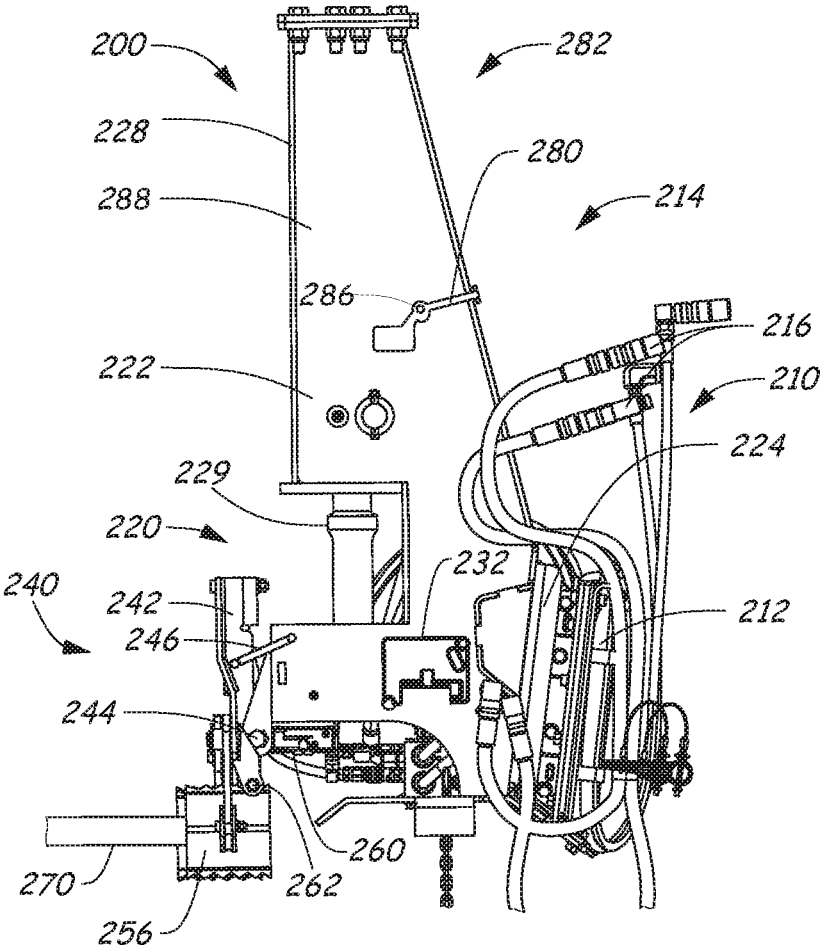
FIG. 3 is a side elevation illustration of a post-driving implement according to one exemplary embodiment.
Figure 4:
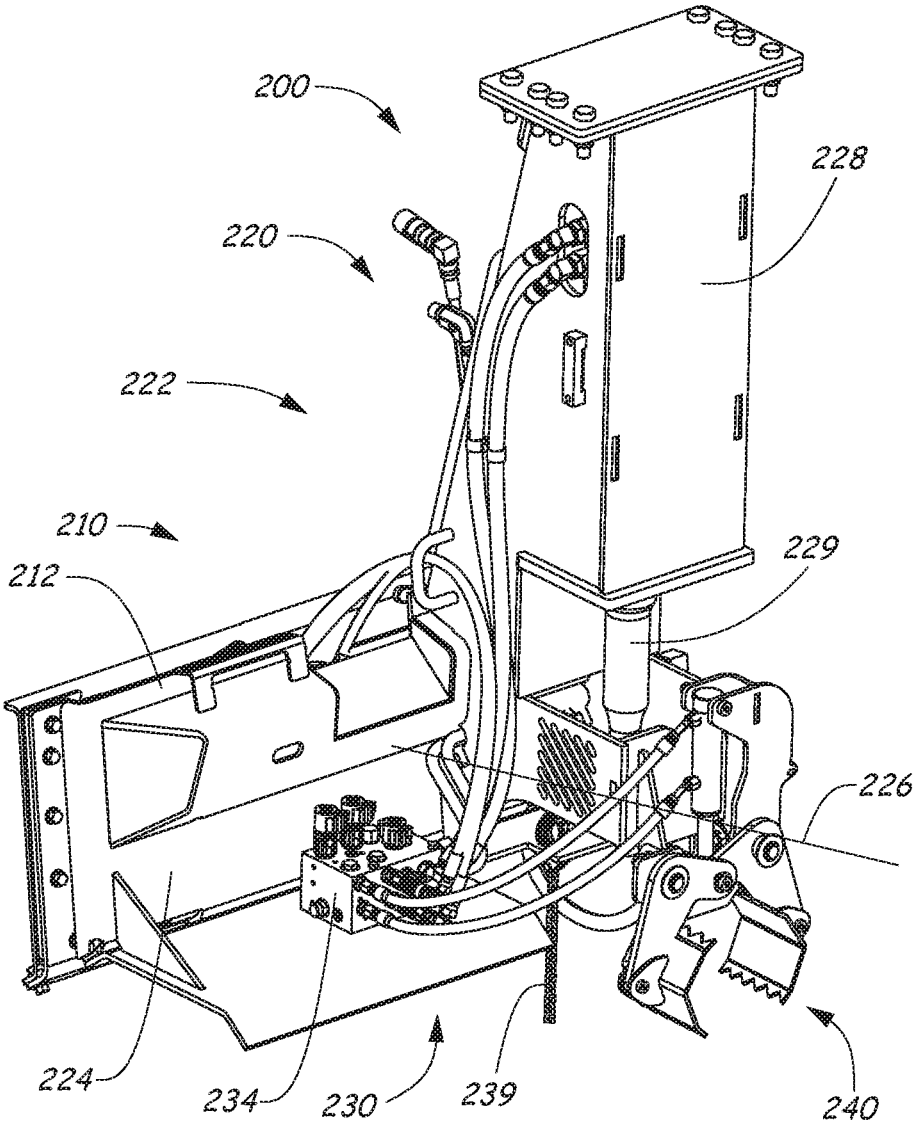
FIG. 4 is a perspective view of the post-driving implement of FIG. 3.

FIGS. 3-4 illustrate a first embodiment of a post driving implement 200. Implement 200 includes a power machine interface 210 and a tool 220 that is operably coupled to the power machine interface 210. The power machine interface 210 includes a machine mount in the form of a generally planar interface plate 212 that is capable of being coupled to an implement carrier on a loader. In other embodiments, various types of machine mounts can be employed. The power machine interface 210 also includes a power port 214, which includes hydraulic conduits 216 that are connectable to conduits on a power machine so that pressurized hydraulic fluid can be selectively provided to actuators on the implement, as will be discussed below. The power port 214 also illustratively includes an electrical connection (not shown), which is connectable to a controller 232 and actuators on valve 234. The controller 232 and valve 234 are included in a control system 230 on the implement 200 for controlling functions thereon.

The tool 220 includes a frame 222 that has a mount 224 that is pivotally connected to the interface plate 212. The mount 224 is pivotable about an axis 226 under power and control from the valve 234. The frame 222 also includes a tower 228 in which is housed a pounding mechanism or hammer 229 that is also under power and control from the valve 234. While one particular pounding mechanism or hammer 229 is shown, this post driving mechanism can by any mechanism or device configured to drive a post into the ground. For example, in some embodiments, pounding mechanism 229 can be a cylinder directly linked to a plate or other support structure such that extension of the cylinder applies force to urge the post into the ground or support surface.

Figure 6:
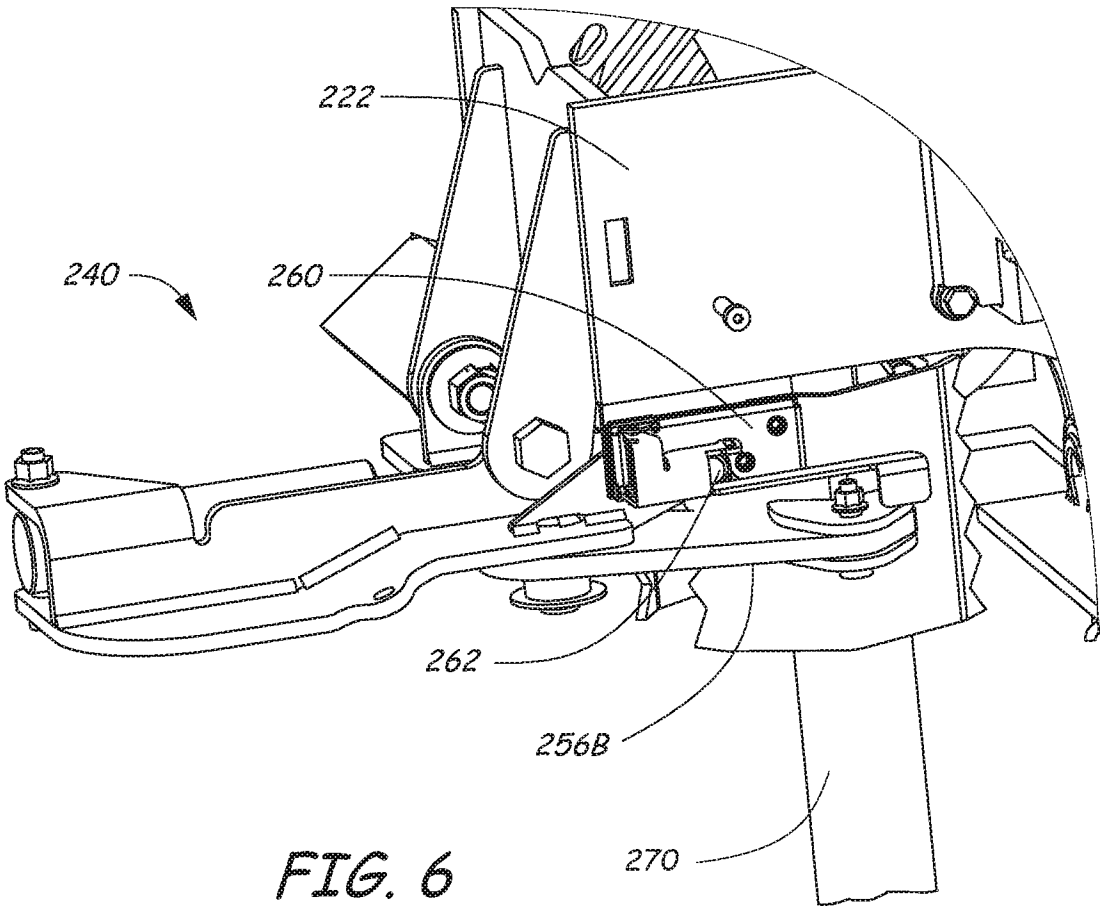
FIG. 6 is a side view illustration of the post driving implement with a post secured by the grabbing tool and with the grabbing tool frame rotated into the latched, horizontal position such that a pounding tool or mechanism can drive the post into the ground.

Implement 200 also includes a grabbing or gripping tool 240 that is pivotable between a vertical position (shown in FIGS. 3-4) and a horizontal position (shown in FIG. 6). In the vertical position, the gripping tool is positioned to grab a post 270 that is lying on a support surface generally in line with the power machine and implement 200. The grabbing tool 240 has a tool frame 242 that is pivotally mounted to implement frame 244 such that it pivots, relative to frame 222, about a pivot axis defined by a pivot joint 244. The grabbing tool 240 is biased toward the vertical position such as by a spring or other bias mechanism 246.

Figure 5:
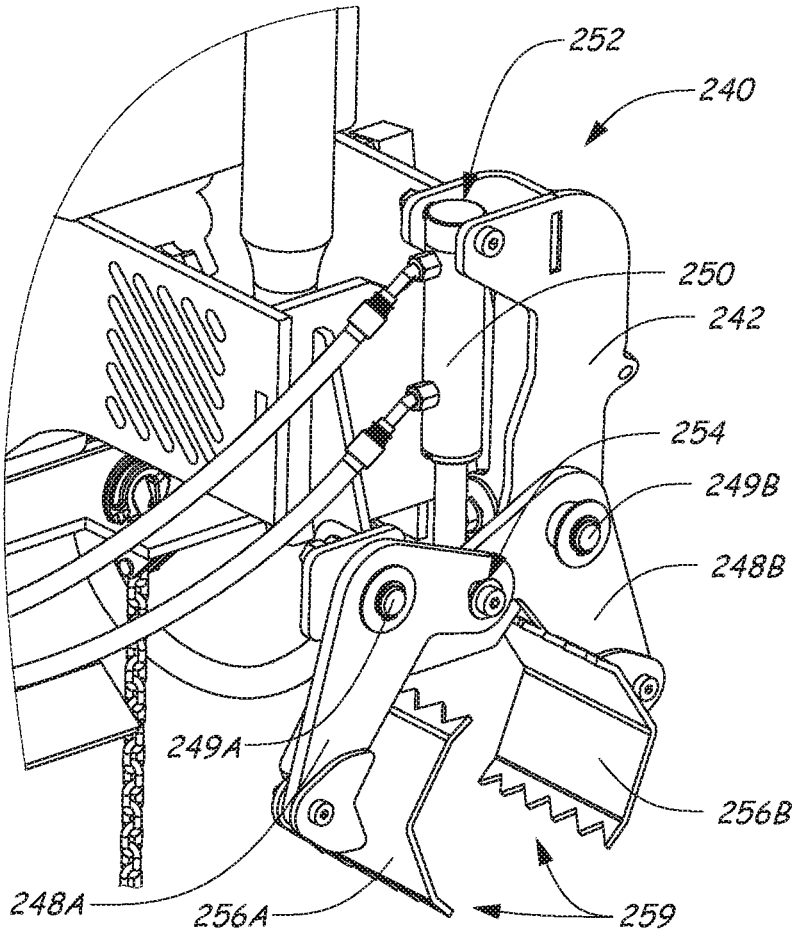
FIG. 5 is a partial perspective view of a portion of the post driving implement shown in FIG. 4, illustrating gripping tool in greater detail.

FIG. 5 shows a close up view of the grabbing tool 240. As mentioned above, the grabbing tool 240 has a frame 242. A pair of arms 248A and 248B (collectively 248) are pivotally mounted to the frame 242 at joints 249A and 249B, respectively. An actuator 250 is coupled to the gripping tool frame 242 at a first coupling location 252 and to each of the arms 248A and 248B at a second coupling location 254. Actuator 250 is under power and control of the control system 230. Actuation of actuator 250 causes the arms 248A and 248B to pivot about their respective joints 249A and 249B. Actuator 250 as shown in FIG. 5 is a hydraulic cylinder mounted at a base end to the frame and at a rod end to the arms. Other types and configurations of actuators can be used in other embodiments. Each of the arms 248A and 248B has a jaw 256A and 256B (collectively 256) attached to an end thereof. In other embodiments, jaws 256 can be a portion of the respective arms 248. The jaws 256 are shaped to engage a post and collectively be able to grab and hold a post such as post 270 shown in FIG. 3 that is lying on the ground. The jaws 256 have serrated edges 259 that are capable of grabbing a post that is inserted into the ground for the purposes of pulling the post out of the ground. This is accomplished by raising the implement 200 such as by powering a lift arm on the power machine to which the implement 200 is operably coupled.

Figure 7:
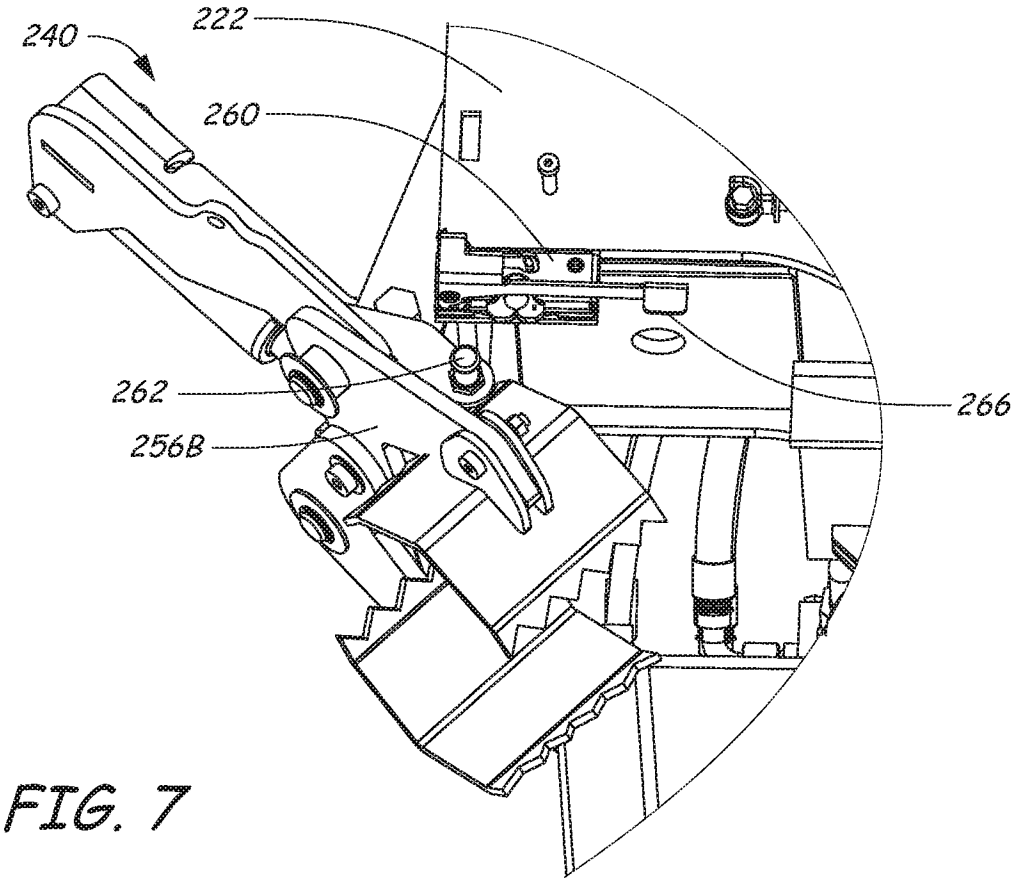
FIG. 7 is a partial perspective view of a portion of the post driving implement showing a grabbing tool in between a biased vertical position and a latched horizontal position.

When jaws 256 are holding a post and implement 200 is lifted off of the ground, for example by raising a lift arm of a power machine to which the implement is operably coupled, the grabbing tool 240 is configured in some embodiments to move under the force of gravity (i.e. without any mechanism provided to drive the grabbing tool to the horizontal position) to a horizontal position as shown in FIG. 6 to allow the post 270 to be positioned directly under pounding mechanism 229. FIG. 7 illustrates the grabbing tool in between the vertical and horizontal positions, but with the post omitted to better illustrates components of the grabbing tool. The weight of post 270 applies force to grabbing tool 240 to overcome the biasing force of bias mechanism 246 (bias mechanism 246 removed from FIG. 6 for clarity purposes), thereby allowing grabbing tool 240 to rotate toward the horizontal position. Rotation of grabbing tool 240 in this manner can thus be achieved without a powered actuation mechanism controlling the rotation. However, in other embodiments, grabbing tool 240 can be moved between the horizontal and vertical positions under power of an actuator. Once in-line with the post pounding mechanism 229, the post 270 can be moved to a position where it is perpendicular to the ground by using the power machine to move the implement 200 (i.e. by moving a lift arm and/or tilt cylinder) and/or tilting the implement 200, which is itself pivotable about axis 226 as is described above. A chain 239 is provided as an orientation mechanism.

In some embodiments, implement 200 has a latch or catch mechanism 260 connected to or formed with frame 222 to hold the grabbing tool 240 in the horizontal position. This latch mechanism 260 catches the grabbing tool by engaging a protrusion 262 on the grabbing tool 240 and holds it in the second or horizontal position so that, when the post is in position to be pounded into the ground, the post doesn't swing out of position. A release lever 266 is provided that, when actuated allows the latch 260 to release the grabbing tool 240 so that it moves back to the first, vertical position after the post has been pounded. In one embodiment, the release lever 266 is actuated by moving the arms 248 so that arm 248B or jaw 256B engages the lever 266. In must be noted that, in some embodiments, grabbing tool can be moved under power back to the vertical position by an actuator.

Figure 8:
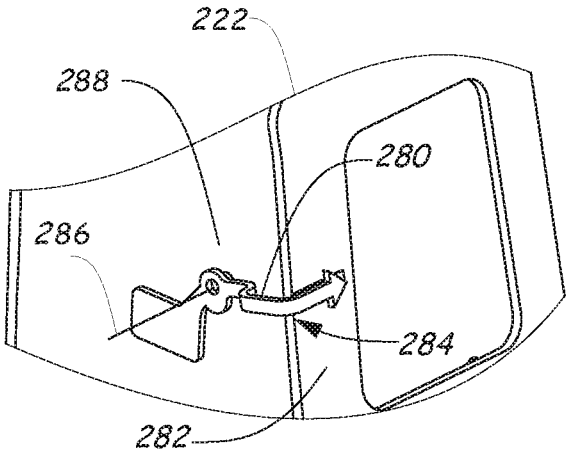
FIG. 8 is an illustration of a level indicator in accordance with some exemplary embodiments.

Referring now to FIGS. 3 and 8, shown is a level indicator 280 mounted on side 288 of the frame 222 of implement 200. The level indicator 280 indicates whether the implement 200 is level with respect to an axis about which an implement carrier on the power machine pivots (i.e. by actuating a tilt cylinder). The axis of pivot is transverse to the power machine and the indicator is also transverse to the power machine. Level indicator 280 is a sight gauge and is configured to indicate level on a surface 282 that is parallel with the axis 286 about which the level indicator pivots and about which it is indicating. This is accomplished by putting a right-angle bend 284 in the indicator member 280. This configuration is advantageous, because during operation, surface 282 is directly in the line of sight of an operator positioned in the operating position of a loader to which implement 200 is operably coupled.

Figure 9:
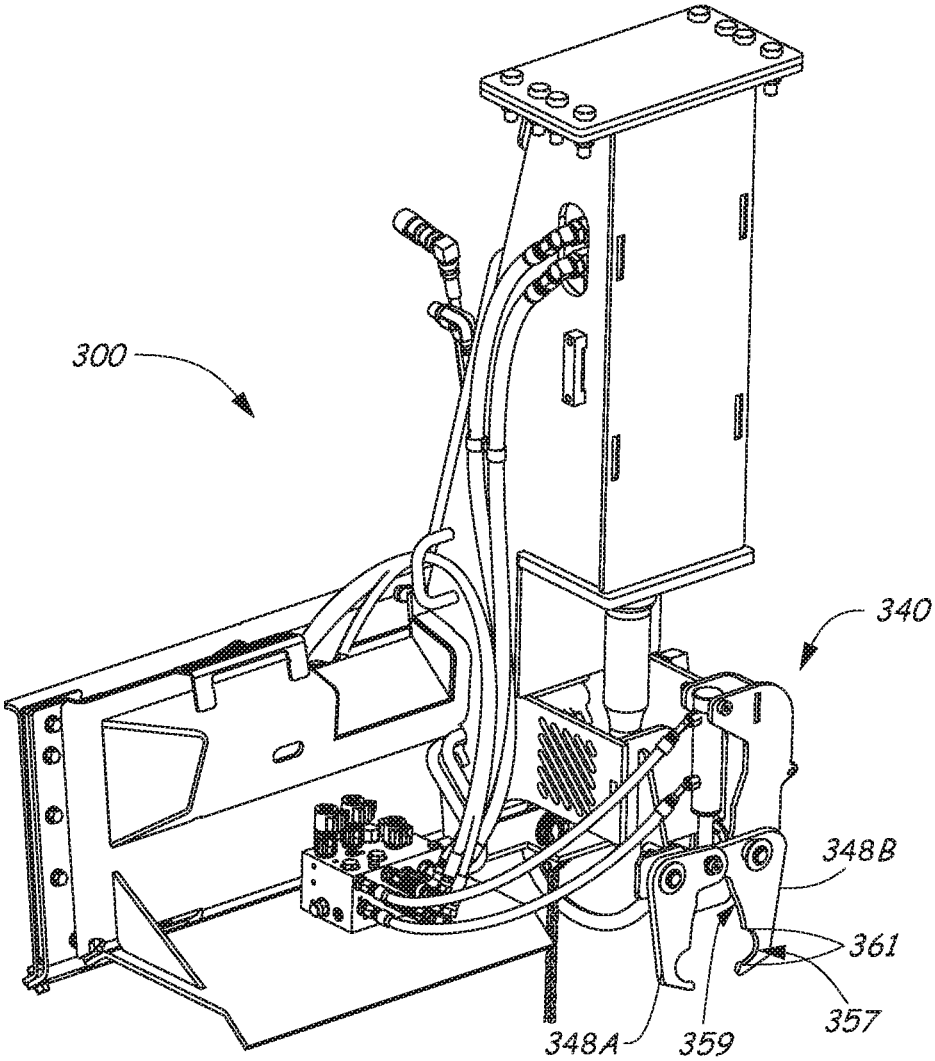
FIG. 9 is a perspective view illustration of another exemplary embodiment of a post driving implement having arms configured to fit posts of differing sizes.

Referring now to FIG. 9, shown is an embodiment of a post driving implement 300 that is substantially identical in most respects to post driving implement 200 described above. Because implement 200 and implement 300 have common features, those features are not necessarily numbered in FIG. 9 or discussed with reference to implement 300. For example, while the frames, the valve of the control system, the pounding mechanism or hammer, and the gripping tool actuator are all shown in FIG. 9, these components can be the same or substantially similar to those discussed above. Further, other components discussed above but not shown in FIG. 9 can be included in implement 300.

One feature that differs between implements 200 and 300 is grabbing tool 340. Although grabbing tools 240 and 340 includes common features which are not described in detail with reference to grabbing tool 340, grabbing tool 340 of implement 300 differs as it includes arms 348A and 348B (collectively referred to as arms 348) that have a profile such that when engaged, arms 348 can fit or grab a post of either of a first size, a second, or a third size and center them in line with the pounding mechanism when the grabbing tool 340 is in the horizontal position. Each of the arms 348 have first gripping surfaces 357 having a first radius and second gripping surfaces 359 having a second radius to engage posts that correspond to those radii. A larger post can be engaged by the points or gripping features 361 on each of the arms 348. Other embodiments can include adapters or features in the arms to accommodate other types of posts, including, for example, T-shaped metal posts.

Figure 10:
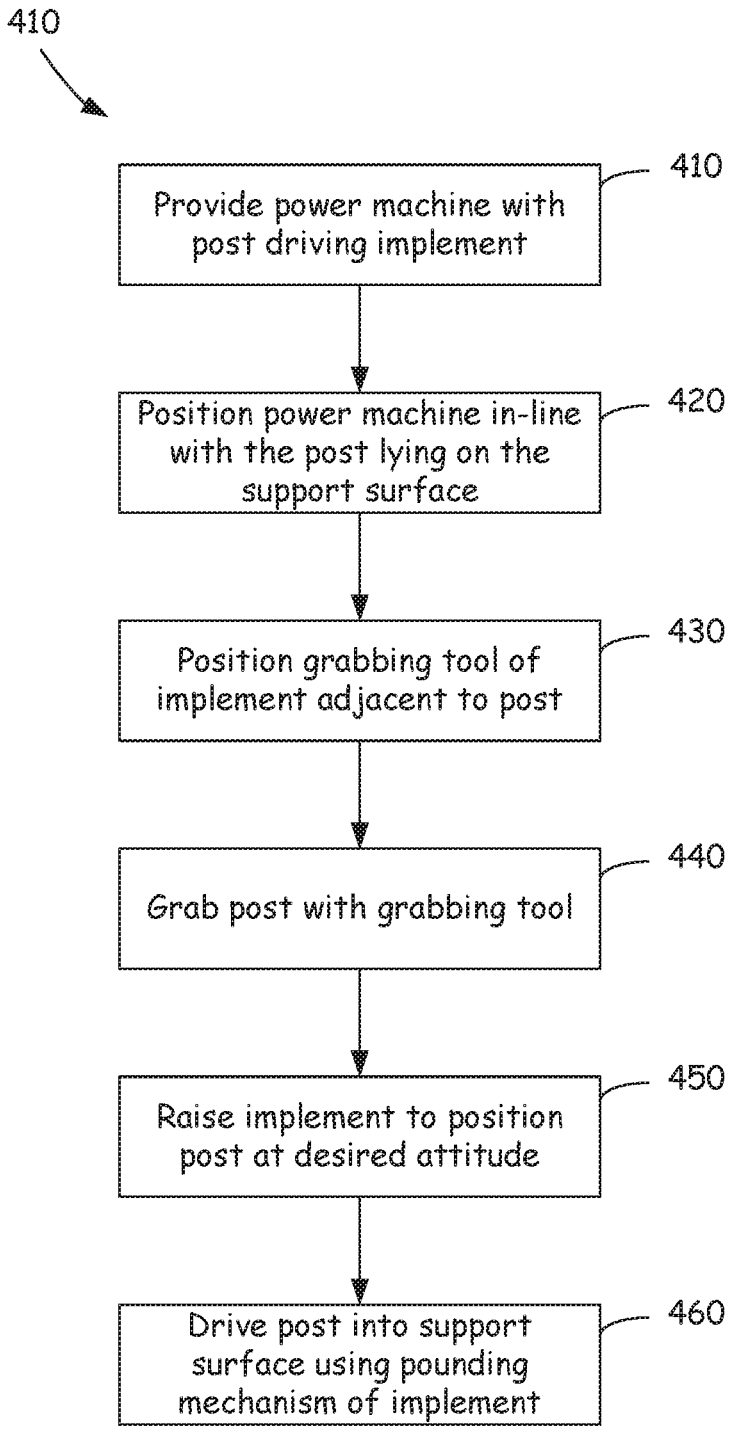
FIG. 10 is a flow diagram illustrating an exemplary method of urging or inserting a post into a support surface.

Referring now to FIG. 10, shown is a flow diagram of a method 400 of urging a post 270 into a support surface using a power machine and a post driving implement as discussed above. As shown at block 410, a power machine 10 is provided or obtained with an implement, such as one of implements (100; 100'; 200; 300) discussed above, attached or mounted to the implement carrier of the power machine. The attached implement has a grabbing tool, such as grabbing tools 240 and 340 discussed above, for grabbing the post.

With the post lying on the ground or support surface, the power machine is positioned in-line with the post as shown at block 420. Positioning the power machine in-line with the post lying on the support surface can refer to positioning the power machine relative to the post such that straight forward travel of the power machine would be in a direction which is generally or approximately co-linear with post. Stated another way, positioning the power machine in-line with the post lying on the support surface can refer to positioning a longitudinal centerline of the power machine, between the rear and front of the machine, such that it is generally co-linear with the post. It is not required that the power machine centerline and the post be perfectly co-linear. Of primary importance and particular benefit, the post driving implement of the disclosed embodiments does not require that the post be positioned transverse to the direction of travel of the power machine. Instead, posts to be inserted into the ground or support surface can be arranged and oriented in a line or along a path over which the power machine can travel to insert the posts into the ground.

With the power machine positioned generally in-line with the post, at block 430 the method is shown to include positioning the grabbing tool 240 or 340 adjacent to the post. This typically includes using the grabbing tool actuator 250 to pivot the arms 248 or 348 of the grabbing tool to spread the arms apart in preparation for grabbing the post. At block 440, the method includes grabbing the post using the grabbing tool. As discussed above, this typically includes using the grabbing tool actuator 250 to pivot the arms together to grip the post.

As shown at block 450, with the post grabbed by the grabbing tool, the implement is raised to position the post in a desired attitude with respect to the support surface. As discussed, in some embodiments, as the lift arm (e.g., work element 35) of the power machine is raised, the grabbing tool pivots from a vertical position used to grab the post to a horizontal position. In the horizontal position, the post is positioned at the desired attitude, for example orthogonal or vertical, relative to the support surface. Further, in the horizontal position of the grabbing tool, the post is positioned directly under the pounding mechanism 229 of the implement. As discussed, in some embodiments, the grabbing tool is locked by a latch or locking mechanism 260 to the implement frame to maintain the post at the desired attitude. At block 460, the pounding mechanism is used to drive the post into the support surface. If the grabbing tool was locked to the implement frame, the lock or latch mechanism can be automatically released to allow the grabbing tool to pivot back toward the vertical position in preparation for grabbing the next post in line.

Although the present invention has been described with reference to preferred embodiments, workers skilled in the art will recognize that changes may be made in form and detail without departing from the spirit and scope of the invention.

What is claimed is:

1. A post driving implement configured to be mounted to a power machine having a lift arm moveable from a fully lowered position to a fully raised position and an implement carrier coupled to the lift arm, the post driving implement configured to insert a post into a support surface, the post driving implement comprising:

an implement frame having a power machine interface configured to engage and be coupled to the implement carrier;

a grabbing tool pivotably mounted to the implement frame and configured to pick up the post lying on the support surface, the grabbing tool capable of pivoting so that the post is positioned at a desired attitude relative to the support surface as the lift arm of the power machine is raised toward the fully raised position;

wherein the grabbing tool is configured to be pivotable relative to the implement frame between a vertical position, in which the grabbing tool is oriented to pick up the post lying on the support surface, and a horizontal position in which the post is positioned to be inserted into the support surface; and a locking mechanism configured to releasably lock the grabbing tool to the implement frame when the post is positioned at the desired attitude, wherein the grabbing tool is locked by the locking mechanism at the desired attitude.

2. The post driving implement of claim 1, wherein the grabbing tool is configured to pick up the post with the post lying on the support surface generally in-line with the power machine.

3. The post driving implement of claim 1, wherein the locking mechanism comprises a latch mechanism coupled to the implement frame, the grabbing tool including a feature which the latch mechanism engages to releasably lock the grabbing tool to the implement frame such that when the grabbing tool is locked to the implement frame the grabbing tool is incapable of pivoting relative to the implement frame.

4. The post driving implement of claim 3, wherein the latch mechanism holds the grabbing tool in the horizontal position when the grabbing tool is locked to the implement frame.

5. The post driving implement of claim 4, and further comprising a pounding mechanism coupled to the implement frame and positioned and configured to engage the post held by the grabbing tool to apply a force to insert the post into the support surface, wherein in the horizontal position the grabbing tool positions the post generally vertically beneath the pounding mechanism such that the pounding mechanism can apply the force to urge the post into the support surface.

6. The post driving implement of claim 4, and further comprising a release mechanism coupled to the latch mechanism and configured to release the grabbing tool from the horizontal position such that the grabbing tool returns to the vertical position.

7. The post driving implement of claim 6, wherein the release mechanism is configured to be engaged by an arm of the grabbing tool to release the grabbing tool from the horizontal position.

8. A post driving implement configured to be mounted to a power machine having a lift arm moveable from a fully lowered position to a fully raised position and an implement carrier coupled to the lift arm, the post driving implement configured to insert a post into a support surface, the post driving implement comprising:

an implement frame having a power machine interface configured engage and be coupled to the implement carrier;

a grabbing tool pivotably mounted to the implement frame and configured to pick up the post lying on the support surface, the grabbing tool capable of pivoting so that the post is positioned at a desired attitude relative to the support surface as the lift arm of the power machine is raised toward the fully raised position;

a locking mechanism configured to releasably lock the grabbing tool to the implement frame when the post is positioned at the desired attitude;

wherein the locking mechanism comprises a latch mechanism coupled to the implement frame, the grabbing tool including a feature which the latch mechanism engages to releasably lock the grabbing tool to the implement frame such that when the grabbing tool is locked to the implement frame the grabbing tool is incapable of pivoting relative to the implement frame;

wherein the grabbing tool is configured to be pivotable relative to the implement frame between a vertical position, in which the grabbing tool is oriented to pick up the post lying on the support surface, and a horizontal position in which the post is positioned to be inserted into the support surface, and wherein the latch mechanism holds the grabbing tool in the horizontal position when the grabbing tool is locked to the implement frame; and a release mechanism coupled to the latch mechanism and configured to release the grabbing tool from the horizontal position such that the grabbing tool returns to the vertical position, wherein the release mechanism is configured to be engaged by an arm of the grabbing tool to release the grabbing tool from the horizontal position.

9. The post driving implement of claim 8, wherein the grabbing tool is configured to pick up the post with the post lying on the support surface generally in-line with the power machine.

10. The post driving implement of claim 8, and further comprising a pounding mechanism coupled to the implement frame and positioned and configured to engage the post held by the grabbing tool to apply a force to insert the post into the support surface, wherein in the horizontal position the grabbing tool positions the post generally vertically beneath the pounding mechanism such that the pounding mechanism can apply the force to urge the post into the support surface.

* * * * *